United States Patent [19]

Katayose et al.

[11] 4,280,411

[45] Jul. 28, 1981

[54] AERIAL CAR SUSPENSION

[75] Inventors: Shinji Katayose, Tokyo; Yukiyoshi Sasabe, Yokohama; Yoshiaki Yokota, Yokohama; Junsuke Kuroki, Yokohama; Shuuji Torii, Tokyo, all of Japan

[73] Assignee: Nissan Motor Company, Limited, Japan

[21] Appl. No.: 111,257

[22] Filed: Jan. 11, 1980

[30] Foreign Application Priority Data

Jan. 25, 1979 [JP] Japan ..... 547734

[51] Int. Cl.[3] ..... B61B 3/06; B61B 7/06; B61C 13/06

[52] U.S. Cl. ..... 104/112; 104/93; 105/150; 105/152; 105/156

[58] Field of Search ..... 105/149, 150, 151, 152, 105/156, 30; 104/93, 112

[56] References Cited

U.S. PATENT DOCUMENTS

| | | | |
|---|---|---|---|
| 489,330 | 1/1893 | Rutter | 105/156 |
| 1,551,223 | 8/1925 | Smith | 104/112 X |
| 2,968,257 | 1/1961 | Schreyer | 104/93 X |
| 3,106,171 | 10/1963 | Julien | 105/149 X |
| 3,587,473 | 6/1971 | Weiss | 104/93 |
| 3,884,153 | 5/1975 | Sugimoto | 104/93 |
| 4,185,562 | 1/1980 | Hatori et al. | 105/152 |

FOREIGN PATENT DOCUMENTS

| | | | |
|---|---|---|---|
| 34458 | 9/1908 | Austria | 105/152 |
| 39550 | 11/1939 | Austria | 105/156 |
| 1072538 | 9/1954 | France | 104/93 |
| 138173 | 4/1930 | Switzerland | 105/150 |
| 941910 | 11/1963 | United Kingdom | 105/152 |
| 1074773 | 7/1967 | United Kingdom | 104/112 |
| 1179822 | 2/1970 | United Kingdom | 105/30 |
| 1303003 | 1/1973 | United Kingdom | 104/93 |
| 1409271 | 8/1975 | United Kingdom | 104/93 |

*Primary Examiner*—John P. Silverstrim
*Assistant Examiner*—Howard Beltran
*Attorney, Agent, or Firm*—Lane, Aitken, Ziems, Kice & Kananen

[57] ABSTRACT

In an aerial transport system having an aerial track such as a cableway or tramway and one or more carriages travelling along the track, a structure for suspending the carriage from the track comprising a beam, both ends of which are pivotally connected to a plurality of frames supporting wheels, the frames being rotatable in a yaw direction about yaw axes with respect to the beam, and a hanger, the upper end of which is connected to the beam in a pivotable position in a pitch direction about a pitch axis with respect to the beam, the improvement comprising, in combination a plurality of separate beams being positioned apart from one another and linked to respective opposing ends by link members in alignment, a plurality of frames respectively connected to both ends of a respective beam in a pivotal position with respect to the beam about respective yaw axes, one wheel being mounted on each of the frames, and a plurality of hangers, the lower ends of which are connected to a carriage body in a pivotable position about the respective yaw axes and pitch axes.

16 Claims, 10 Drawing Figures

AERIAL CAR SUSPENSION

BACKGROUND OF THE INVENTION

The present invention relates to a structure of a carriage in an aerial transport system, such as an aerial tramway or cableway system. More specifically, the invention relates to a suspension structure for suspending a carriage from the aerial track of the transport system.

For simplification of the description, the word "carriage" is intended to include not only the carriage per se but also the vehicle, and the work "cableway" is intended to include not only the cableway but also a tramway.

As is well-known, there have been various aerial cableway systems for transporting passengers and/or articles along long mountain ascents and descents, and over canyons and rivers. Such cableway systems have also been applied to automatic manufacturing lines in factories.

Such a cableway system generally comprises an aerial track suspended by two or more stationary towers and defining the cableway, and one or more carriages travelling along the track. The carriages are suspended from the track by means of various suspension members. The suspension members generally comprise a hanger, its upper end connected to a beam, and frames holding pairs of wheels and provided on opposite longitudinal ends of the beams. The running wheels ride on the track and rotate to move the carriage along the track. The carriage is suspended for rotation about yaw axes and pitch axes.

In FIGS. 1 and 2, there are illustrated well-known typical constructions of suspension structures suspending the carriage from the aerial track. FIG. 1 shows a suspension structure in which a carriage body 5 is suspended from an aerial track 7 by a suspension member 8 including a pair of frames 2 respectively holding pairs of running wheels 3. The frames 2 are connected to a beam 1 for rotation in the yaw direction about vertical axes "$Y_1$" with respect to the beam 1. A hanger 4 is connected to the beam 1 for rotation about an axle 6 in the pitch direction with respect to the beam 1 and perpendicular to the track 7. Since the carriage body 5 is fixedly secured to the lower end of the hanger 4, it cannot move with respect to the hanger in any direction and thereby subjects the joining portion therebetween to a concentration of load.

With this construction, as each pair of wheels 3 are held or supported rotatably about horizontal axes on the frame 2 so as to rotate together with the frame 2 with respect to the beam 1 and if curvature of the track is smaller than the allowable minimum curve radius which may be determined in accordance with the distance between the pair of wheels held on the common frame 2, the carriage cannot travel through the curved portion of the cableway. Therefore, the minimum radius of curvature of the track 7 is restricted due to the distance between the wheels on the same frame.

While, in such a construction of the suspension structure, the frames 2 are fixedly connected by the rigid beam 1 and cannot rotate in the pitch direction with respect to the beam 1 to possibly cause the beam to be subjected to vertical distortion when elevations of the respective frames are different. This may result in shortening the lifetime of the beam. Further, upon travelling of the carriage through the curvature of the track, respective wheels are subject to rotational moment to cause an increase in friction between the wheels and the track. Thus, the lifetime of both the wheels and track are substantially shortened. Yet further, since in such a construction, the carriage has a rigid beam of substantially heavy weight above the track, the carriage does not have the desired sufficient stability.

FIG. 2 shows another typical construction of the suspension structure for suspending the carriage from the aerial track. A carriage body 15 is suspended from an aerial track 17 by means of a suspension member 18. The suspension member 18 comprises a rigid beam 11, frames 12 rotatably connected to both longitudinal ends of the beam 11 and a hanger 14. Each frame is provided with a pair of running wheels 13 rotatable about substantially horizontal axles 19 of the frame 12 to travel along the track 17. Each frame 12 is rotatable in the yaw direction "$Y_2$" and the pitch direction $P_2$ around axle 19 with respect to the beam 11. The hanger 14 is rotatably suspended, with respect to the beam 11, about axis "$Y_3$". Also in this construction, the carriage body 15 has no freedom of motion with respect to the hanger 14.

Since such construction allows the frame 12 to rotate in the pitch direction, with respect to the beam 11, it can eliminate vertical distrotion due to a vertical movement of bending subjected to the beam 11. However, there remains a problem that since, in such a construction a rigid beam of substantially heavy weight is employed, it may cause bringing upwardly the gravity center of the carriage so as to make the same unstable.

Further, in both constructions as above-mentioned, the hangers 4, 14 and the carriage bodies 5, 15 are respectively fixed together and therefore, static and dynamic loads are applied to the joining portion between the hanger and carriage body. In particular, the concentration of static and dynamic load is extreme when the carriage goes up or down a slope, or the load is uneven. It should be noted that the static load on the joining portion between the carriage body and hanger is generally caused by the gravity of the carriage and whatever is contained therein, while the dynamic load being subjected to the joining portion is caused in general directions.

Further, reinforcement of the joining portion against the concentration of the load is required to have a strong structure which unavoidably increases the weight. The reinforcement has been required not only for the joining portions but also for respective segments of the suspension members as well as the track. This may result in a substantially high cost for the cableway system.

Still further, when two or more carriages 15 of FIG. 2 are trained together, the respective frames 12 are connected with a traction link 16, as shown in FIG. 3. However, if the carriage ascends or descends a slope, the carriage swings in a substantially pitch direction about the pivoting points 21 of the hanger 14 with respect to the beams 11, as shown by dotted lines in FIG. 3. This may cause the carriage bodies 15 to collide. Thus, a sufficient interval to prevent collision between the carriage bodies 15 is required for safety. Since the interval between the carriage bodies 15 is substantially longer, the connecting link which forms a chord between the leading and trailing carriages when they run on a curved track is thus also lengthened. Consequently, the radius of the track becomes too small and it is impossible for the carriage to run thereabout and the turning curvature of the track becomes limited and shortens the radius of the curvature.

It would be possible to eliminate the problem of the carriages colliding with one another on an ascending slope or due to inertial running of the trailing carriage by employment of a rigid link 22, as shown in FIG. 4. However, the rigid link 22 causes the carriage bodies to tilt or rotate out of line when moving along a slope, as shown by the dotted line in FIG. 4. This tilting or moving out of line results in loosening of the containers or in the discomfort or danger to the passengers in the carriage bodies.

The present invention is to remove drawbacks and disadvantages as those above-mentioned which have characterized previous suspension structures, and more particularly to provide an arrangement for suspending an aerial cableway or carriage which reduces the weight above the track, increases stability of the carriage and when several carriages are linked together prevents collision of adjacent carriages.

SUMMARY OF THE INVENTION

It is, therefore an object of the present invention to provide a structure of a carriage including a suspension mechanism capable of increasing the stability of the carriage by an arrangement of pivotal axes.

Another object of the invention is to provide a suspension mechanism in which each running wheel riding on an aerial track of a tramway or cableway can rotate in the yaw direction about axes, independently with respect to the other wheels, so as to provide the track with a shortening of the curvature radius.

A further object of the invention is to provide a suspension mechanism including hangers each of the which having a lower end pivoted at the carriage so as to allow the carriage to rotate in both pitch and yaw directions about a pitch axis and yaw axis so that when a plurality of carriages are trained, the carriages can rotate about the axes in substantially parallel relationship with respect to one another.

A still further object of the invention is to provide a suspension mechanism having separate beams positioned apart from one another each of which being pivotally connected to frames having running wheels at longitudinal both ends thereof, for reducing the weight of the carriage running about the track.

In order to accomplish the above-mentioned objects, there is provided, according to the present invention, in an aerial transport system having an aerial track such as a cableway or tramway and one or more carriages travelling along the track, a structure for suspending the carriage from the track comprising a beam, both ends of which are pivotally connected to a plurality of frames supporting wheels, the frames being rotatable in the yaw direction about yaw axes with respect to the beam, and a hanger, the upper end of which is connected to the beam in a pivotable position in the pitch direction about a pitch axis with respect to the beam, the improvement comprising, in combination a plurality of separate beams being positioned apart from one another and linked to respective opposing ends by link members in alignment, a plurality of frames respectively connected to both ends of a respective beam in a pivotal position with respect to the beam about respective yaw axes, one wheel being mounted on each of the frames, and plurality of hangers, the lower ends of which are connected to a carriage body in a pivotable position about respective yaw axes and pitch axes.

Preferably, the link member is made of flexible materials. Further, it may be desirable that the hangers are respectively provided with damper means at the lower portion thereof. One end of the damper means is connected to the carriage body so as to bias respective hangers in the direction apart from one another.

BRIEF DESCRIPTION OF THE DRAWINGS

The present invention will become more fully understood from the detailed description given hereinbelow, and from the accompanying description of several preferred embodiment of the present invention, which however, are not to be taken as limiting of the present invention in any way, but are for the purpose of elucidation and explanation only.

In the drawings.

DESCRIPTION OF THE PREFERRED EMBODIMENT

Figure 1:
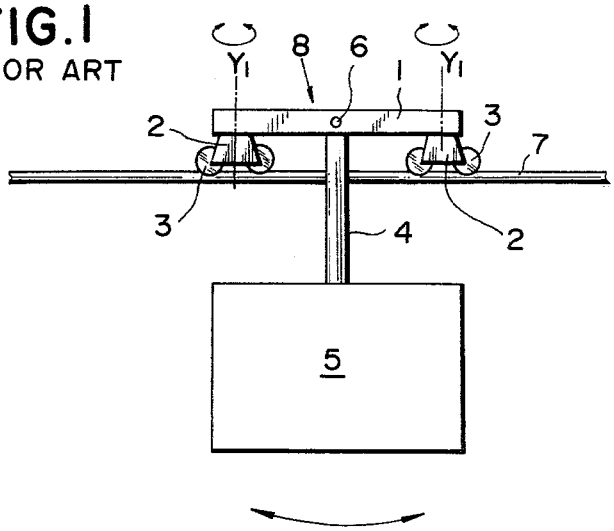
FIG.1 PRIOR ART
FIG. 1 is side view illustrating prior art construction.
Figure 2:
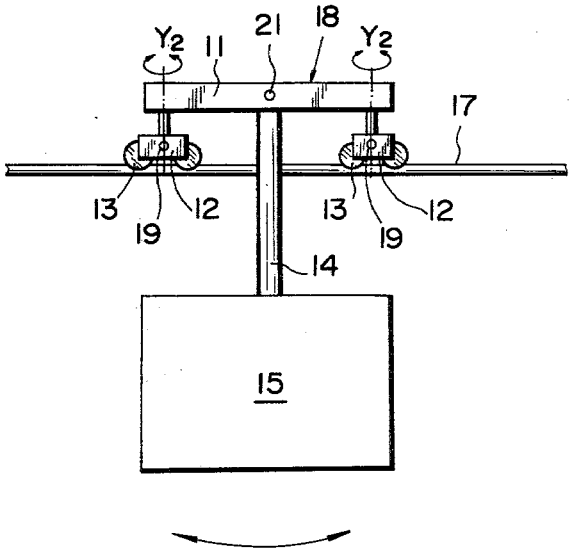
FIG.2 PRIOR ART
FIG. 2 is side view illustrating prior art construction.
Figure 3:
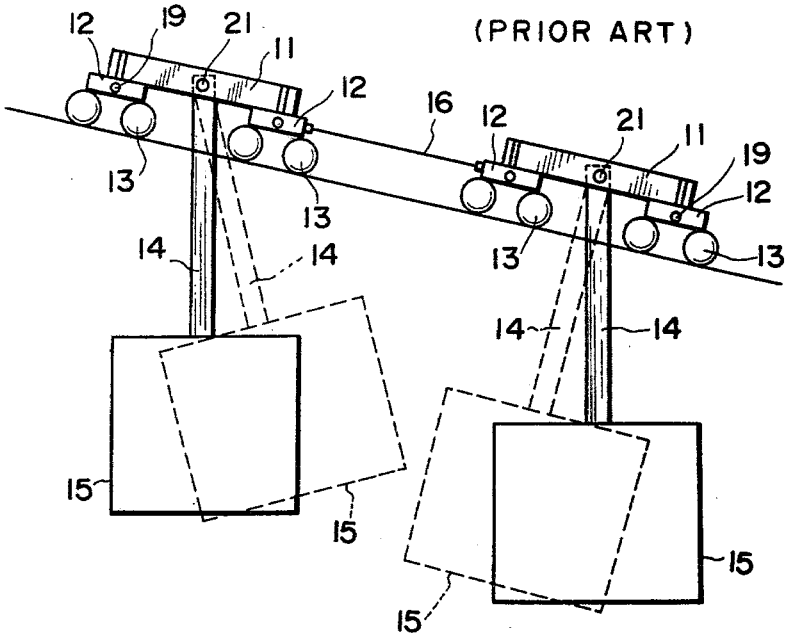
FIG.3 (PRIOR ART)
FIG. 3 is a side view illustrating prior art connected cars ascending a slope.
Figure 4:
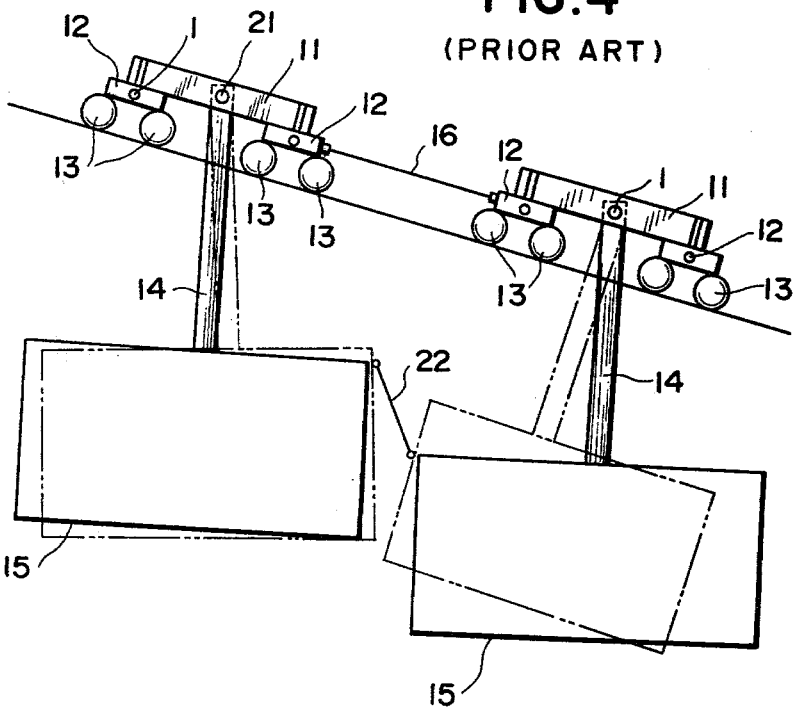
FIG.4 (PRIOR ART)
FIG. 4 is a side view illustrating prior art connected cars ascending a slope.
Figure 5:
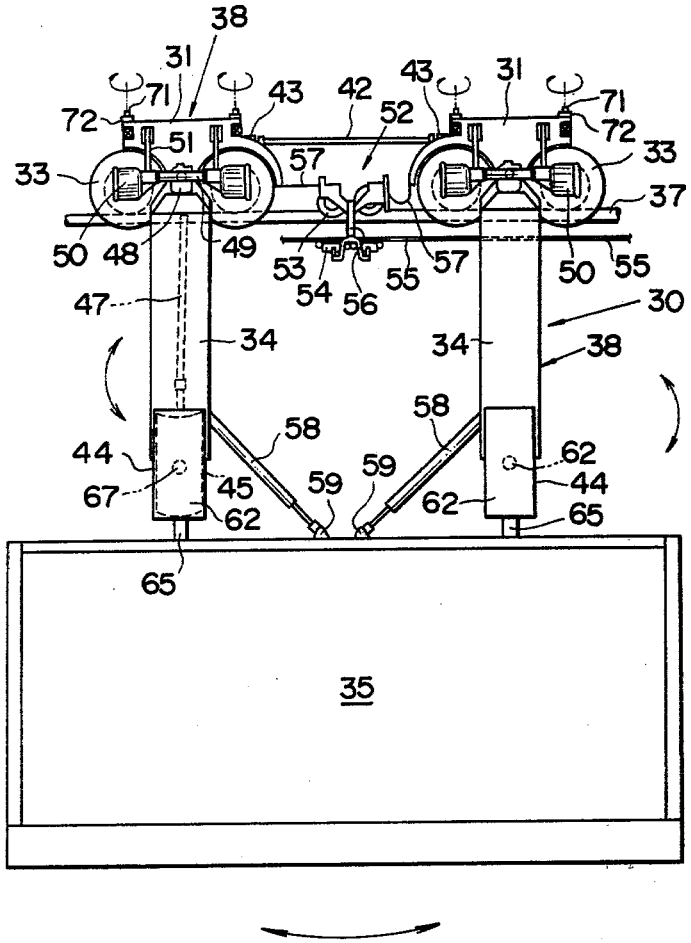
FIG. 5 is a side view of a carriage illustrating a preferred embodiment of this invention.
Figure 6:
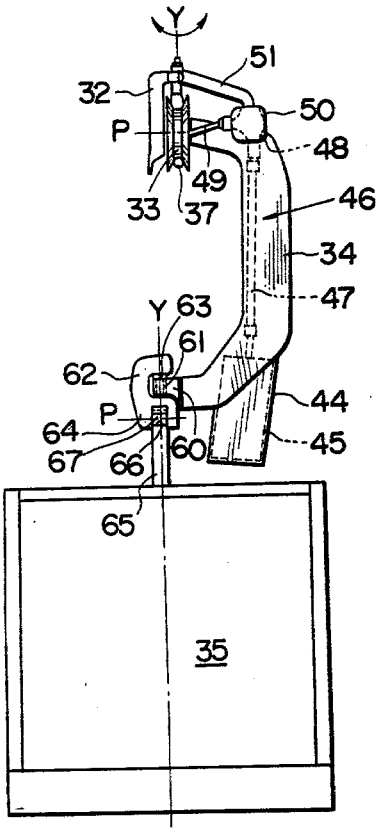
FIG. 6 is a front elevational view of the carriage of FIG. 5, illustrating a preferred embodiment of this invention.
Figure 7:
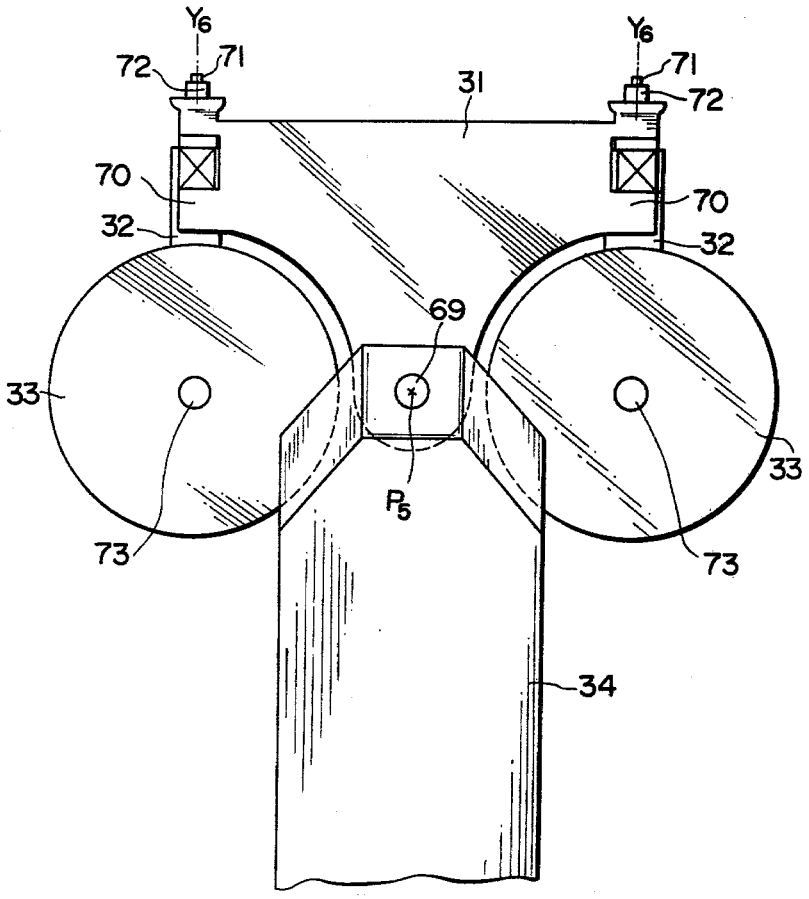
FIG. 7 is a somewhat schematical enlarged view of a part of the structure of FIG. 5.

Referring now to FIGS. 5 to 7, there is illustrated a carriage 30 suspended from an aerial track 37 by a pair of suspension members 38 according to the preferred embodiment of the invention. Each suspension member 38 comprises a beam 31 and a hanger 34. The beams 31 are separated and positioned apart from one another and connected by a link 42. Each end of the link 42 is universally engaged to the beams 31 through ball joints 43. In the preferred construction, the link 42 may be provided with flexibility. However, the link 42 is flexible, in itself since the beams 31 are biased in the direction apart from one another by hereafter described dampers 58 and therefore, the link 42 is constantly stretched, thus maintaining the beams 31 at a substantially fixed distance apart from one another.

The hanger 34 is formed in a substantially hollow square or rectangular-shaped configuration in cross-section. The hanger 34 is equipped with a driving box 44 containing therein an electric driving means 45, such as a driving motor. As shown in the left-side of FIGS. 5 and 6, through the opening of the hanger 34, there is disposed transmission means 46 comprising a rod 47, a differential gear unit 48, a rod 49 and a driving gear box 50. The gear boxes 50 are respectively suspended by arms 51 which extend from the beam 31. Preferably, the rod 47 is constructed of an expansile member such as a telescopic rod. The output of the electric driving means 45 is transmitted through the transmission means 46 to a pair of wheels 33 to drive the wheels 33.

The wheels 33 are respectively engaged with the track 37 to rotate on or run along the track 37. The pairs of wheels 33 are respectively connected to both longitudinal ends of the beam 31 through respective frames 32.

As shown in FIG. 5, between the pair of beams 31, there is provided an electric current collecting unit 52 having a pair of wheels 53 and a pair of current collecting shoes 54. The current collecting shoes 54 are in resilient contact with a pair of current carrying cables 55 through respective arms 56, the cable 55 being suspended from the track 37 by a plurality of brackets (not shown) in parallel relationship with respect to the track 37 and with respect to the other cable 55. The current collecting unit 52 is connected to the beams 31 by a pair of cables 57. The cables 57 are of the same length, but shorter than the distance between the beams 31 so as to prevent colliding of the unit 52 with the sides of the rear beam 31 (right-side beam in FIG. 5). Thereby, the current collecting unit 52 trails the forward beam 31 (left-side beam of FIG. 5) when the carriage 30 travels along the track 37 in the direction of from right to left in FIG. 5. Although it is not clearly shown in the drawings, the current collecting unit 52 is electrically connected to the driving means 45 so as to supply electric power to the driving means 45 and drive same. Thereby, the carriage 30 can travel along the track 37 by self-propulsion.

A pair of dampers 58 are provided between the hangers 34 and the carriage body 35. One end of each damper 58 is connected at the center portion of the carriage body 35 through a bracket 59. The other end of each damper 58 is connected to the lower portion of the hangers 34. The dampers 58 restrict the carriage from swaying and bias respective corresponding hangers 34 in the direction apart from one another.

As is apparently shown in FIG. 6, the hanger 34 is connected to the carriage body 35 at the lower end thereof. The hanger 34 is formed of a substantially C-shaped configuration at the lower end 60 on which a vertical aperture 61 is provided. The lower end 60 of the hanger 34 is engaged with the upper portion of a substantially reversed Y-shaped joint 62 having a vertical axle 63 both ends of which are received at the joint 62 through the aperture 61. The axle 63 consists of a pivot for rotation of the carriage body 35 in the yaw direction with respect to the hanger 34. Thereby, the hanger 34 allows the carriage to move through the joint 62 rotating in the yaw direction about the yaw axis "$Y_4$" around the vertical axle 63. The lower end of the joint 62 has bifurcated leg portions 64 engaged to a suspension post 65 protruding upwardly from the ceiling of the carriage body 35. On the upper end of the post 65, there is formed a horizontal aperture 66 to receive a horizontal axle 67 both ends of which are secured to the lower end of respective leg portions 64 of the joint 62. The axle 67 consists of a pivot for the carriage body 35 to move through the joint 62 and rotate in the pitch direction about the pitch axis "$P_4$" with respect to the hanger 34 around the axle 67.

As shown in FIGS. 5 and 7, each hanger is pivoted to the beam 31 at the upper end thereof by a substantially horizontal axle 69, in a well-known manner. Thereby, the hangers 34 are respectively rotatable in the pitch direction about a horizontal pitch axis "$P_5$" around the axle 69 with respect to the beam 31. As is apparently shown in FIG. 7, each beam 31 has bifurcated horizontal legs 70 extending in the forward and backward directions from both longitudinal ends of the beam 31. On the upper leg of each bifurcated leg 70, there is formed an aperture to receive a vertical axle 71. Between each bifurcated leg 70 the upper end of the frame 32, which is formed into a substantially reversed L-shaped configuration, is connected. On the upper end of the frame 32, there is formed an aperture to receive the axle 71. The lower end of the axle 71 is recieved in a recess formed on the lower leg of the bifurcated legs 70, while the upper end of the axle 71 protrudes upwardly from the upper leg. On the upper end of the axle 71, a fastening member 72 is engaged to fix the axle 71 on the bifurcated legs 70. Thereby, the frame 32 can rotate in the yaw direction about a yaw axis "$Y_6$" around the axle 71 with respect to the beam 31, independently with respect to the other frame 32. The frames 32 respectively support the horizontal axle 73 with the wheels 33 being rotatably mounted thereon. Since electric power collected through the current collecting unit 51 is supplied to the driving means 45 and thus drives the driving means 45, power of the driving means 45 is transmitted to the differential gear unit 48 through expansile rod 47. A driving gear (not shown) of the differential gear unit 48 is thereby actuated to rotate. The rotation of the driving gear is transmitted to a gear (not shown) disposed within the gear box 50 through an idler gear (not shown) included in the differential gear unit 48 and an axle 49. Thereby, an output gear (not shown) contained in the gear box 50 and secured to the axle 73, is rotated together with the wheel 33 fixed to the axle 73.

When the carriage 30 moves around a curvature of the track 37, each wheel 33 rotates together with its frame 32 around its vertical axle 71 in the yaw direction. This allows the carriage 30 to run on a track 37 whose path is tightly curved. When climbing or descending a slope or when accelerating, the carriage 30 rotates around the pitch axis around axle 67 relative to the hangers 34, so that the carriage 30 may smoothly run on an inclined track 37. When the carriage 30 swings, for example, the hangers 37 function as a parallel linkage allowing the carriage body 35 to move while remaining parallel to the cable. At this time, the damper 58 functions so as to moderate carriage swinging.

Figure 8:
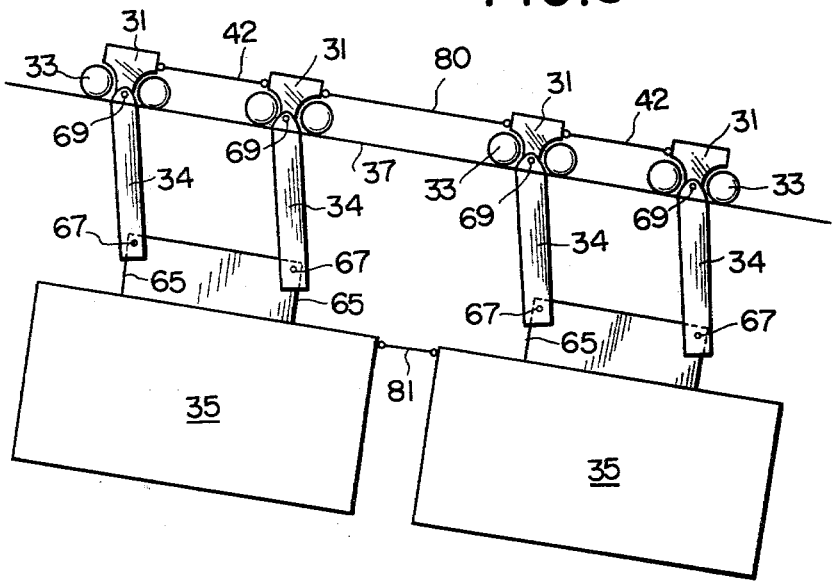
FIG. 8 is a side view illustrating connected cars which are suspended according to the present invention.

When interconnecting several carriages as shown in FIG. 8, it is necessary to only interconnect between adjacent beams 31 and their corresponding carriage 35, respectively, with the connecting rods 80 and 81 and the carriage body 35 will run without being substantially pushed or pulled by the connecting rods 81 even when running on a slope. This is because the parallelogram formed by the carriage body 35, the pair of hangers 34 and the beams 31 functions as part of the linkage.

Figure 9:
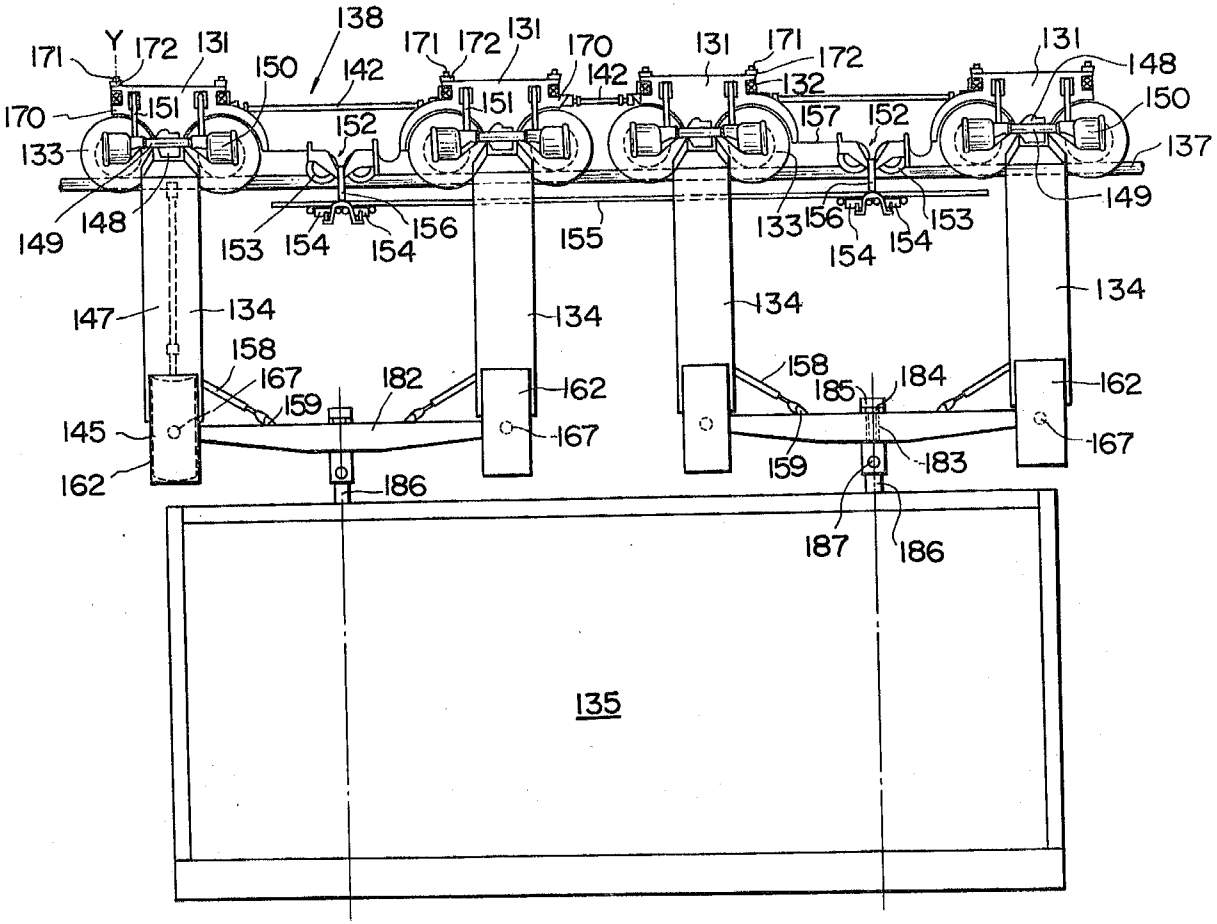
FIG. 9 is a side view illustrating a carriage according to another preferred embodiment of the present invention.
Figure 10:
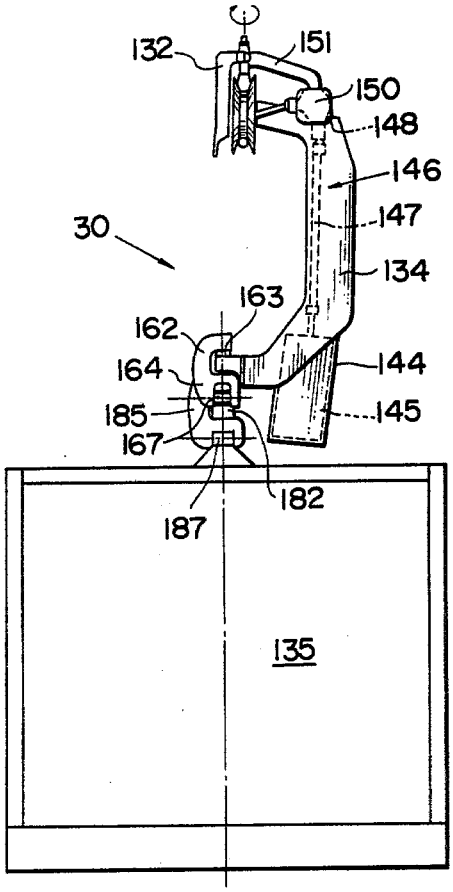
FIG. 10 is a front elevational view of a carriage of FIG. 9.

FIGS. 9 and 10 illustrate another embodiment of the present invention which may be employed for a carriage which is used for substantially heavy loads. In this embodiment, parts which correspond to parts in the first embodiment, and have the same functions, are denoted by reference numerals which are one hundred units greater than those of the corresponding parts of the first embodiment. In this embodiment, the construction of the beams 131 and hangers 134 are entirely the same as those in the first embodiment. However, there are employed four hangers 134 and four beams 131. The principle difference between the second embodiment and the first embodiment is a means for joining the lower end of each pair of hangers 134 and a carriage body 135. In the second embodiment, there are employed a pair of struts 182. Both ends of each strut 182 are connected to each pair of hangers 134 through joints 162. Each hanger 134 is formed in a substantially C-shaped configuration and has a lower end 160 provided with an aperture 161 to receive a substantially vertical axle 163 of the joint 162. The joint 162 has bifurcated legs 164 on the lower portion where each end of the strut 182 is engaged. Each end of the strut 182 is provided with a substantially horizontal apeture 166 to receive an axle 167 of the joint 162. Thereby, the strut 182 can rotate relative to the hanger 134 around vertical axes "$Y_7$" via axles 163 and around horizontal axes "$P_7$" via axles 167.

The central portion of each strut 182 is formed in a vertical aperture 183 through which the vertical axle 184 of a center joint 185 is disposed. The lower end the center joint 185 is pivotally connected with a suspension post 186 which protrudes upwardly from the ceiling of the carriage body through an axle 187. Thus, the carriage 135 is rotatable around horizontal axes "$P_8$" via the axle 187 and around vertical axes "$Y_8$" via the axle 184, with respect to the struts 182.

It should be noted that, in this specification, the expressions "horizontal axis" and "horizontal axle" are used to mean that the axis or axle extend horizontally in the direction lateral to the aerial track.

While this embodiment is constructed in such a manner that each unit which forms a parallelogram linkage contains four wheels, there may be freely employed other constructions having six, ten or a greater even numbers of wheels by connecting plural units which contains two wheels per unit. Employment of such constructions also provides the same effect as in the above-mentioned embodiment.

There, it is seen that the parallelogram-like construction available according to the present invention provides a stable and yet flexible suspension system for a carriage. Further, a train of carriages may be closely interconnected, without any substantial danger of same colliding with one another when the train is going up or coming down a slope, or accelerating or decelerating. Also, stress of the weight of the carriage is well-distributed over the rope, due to several hangers being provided.

Although the present invention has been shown and described with respect to several preferred embodiments, it should not be considered as being limited to these or mere and simple generalizations or other detailed embodiments. Yet, further alterations can be made to the form and the details of any particular embodiment without departing from the principles of the present invention. Therefore, it is desired that the scope of the present invention and the breadth of the protection sought to be granted by Letters Patent, should be defined solely by the accompanying claims.

What is claimed is:

1. An aerial transport system having an aerial track defining a way along which a carriage travels, the carriage being suspended from said aerial track by a suspending member which includes at least one beam connected with a wheel supporting frame in a pivotal position about a vertical axis to the wheel supporting frame and said beam connected with a hanger supporting the carriage in a pivotal position about a substantially horizontal axis, wherein the improvement comprises:

joining means interposed between a lower end of said hanger and said carriage and having both vertical and horizontal axes, whereby said wheel supporting frame, beam, hanger and carriage are respectively universally pivotable in the yaw direction and the pitch direction with respect to each of the elements connected thereto.

2. A suspension structure as claimed in claim 1, wherein said hangers are respectively provided with damper means at the lower portion thereof, one end of said damper means being connected to said carriage body so as to bias the respective hangers in the direction apart from one another.

3. A suspension structure as claimed in claim 2, wherein said beam trails an electric power collecting unit which is connected with one end of said beam and travels along an electric power cable provided substantially parallel to said aerial track.

4. An aerial transport system including an aerial track defining a way along which a carriage travels, the carriage being suspended from said aerial track to rotate in the yaw and pitch directions with respect to the track, wherein a structure for suspending the carriage from the track comprises:

a plurality of beams located in spaced apart relationship with respect to one another, each of said beams having vertical axes on both ends thereof and a horizontal axis on the transversely central portion thereof;

a pair of wheel supporting frames having one end rotatably supporting a wheel engagable with said track and rotating therealong, and the other end rotatably connected with both ends of each beam, said frame being rotatable in the yaw direction about said vertical axis of said beam; and a hanger having one end connected with said beam and being rotatable about said horizontal axis of said beam and the other end provided with joining means which has both vertical and horizontal axes and through which said other end is connected with said carriage so that said carriage is universally rotatable in yaw and pitch directions about said vertical and horizontal axes of said joining means.

5. A suspension structure as claimed in claim 4 further comprising a link member for connecting the opposed ends of adjacent separated beams and wherein said link member is made of flexible material.

6. A suspension structure as claimed in claim 4, wherein said hangers are respectively provided with damper means at the lower portion thereof, one end of said damper means being connected to said carriage body so as to bias the respective hangers in the direction apart from one another.

7. A suspension as claimed in claim 6, wherein said beam trails an electric power collecting unit which is connected with one end of said beam and travels along an electric power cable provided substantially parallel to said aerial track.

8. A suspension structure as claimed in claim 4, wherein an electric power collecting unit is connected to both of the opposing ends of said beams with a flexible link member, said collecting unit traveling along an electric power cable provided substantially parallel to said aerial track.

9. A suspension structure as claimed in claim 8, wherein said flexible link member has a length less than a distance between said beams so that the collecting unit avoids the rearward beam.

10. In an aerial transport system having an aerial track such as a cableway and a carriage travelling along the track, a structure for suspending the carriage from the track including a beam, both ends of which are pivotally connected to a plurality of frame supporting wheels, said frames being rotatable in a yaw direction about yaw axes with respect to said beam, and a hanger, the upper end of which is connected to said beam in a pivotable position in a pitch direction about a pitch axis with respect to said beam, the improvement comprising, in combination:

a plurality of separated beams being positioned apart from one another and linked to respective opposing ends by link members in alignment;

a pair of frames respectively connected to both ends of each of said beams in a pivotal position with respect to said beams about respective yaw axes;

one wheel being mounted on each of said frames; and joining means provided on the lower end of said hanger and having yaw and pitch axes so that said joining means connects said carriage to said hanger in a universally pivotable position in the yaw and pitch directions.

11. A suspension structure as claimed in claim 10, wherein said link member is made of flexible material.

12. A suspension structure as claimed in claim 11, wherein both ends of said link member is connected to respective ends of said beams through ball joints.

13. A suspension structure as claimed in claim 10, wherein said hangers are respectively provided with damper means at the lower portion thereof, one end of said damper means being connected to said carriage body so as to bias the respective hangers in the direction apart from one another.

14. A suspension structure as claimed in claim 13, wherein said beam trails an electric power collecting unit which is connected with one end of said beam and travels along an electric power cable provided substantially parallel to said aerial track.

15. A suspension structure as claimed in claim 10, wherein an electric power collecting unit is connected to both of the opposing ends of said beams with a flexible link member, said collecting unit traveling along an electric power cable provided substantially parallel to said aerial track.

16. A suspension structure as claimed in claim 15, wherein said flexible link member has a length less than a distance between said beams so that the collecting unit avoids the rearward beam.

* * * * *